US010493002B2

(12) United States Patent
Chan et al.

(10) Patent No.: US 10,493,002 B2
(45) **Date of Patent: *Dec. 3, 2019**

(54) MODULAR PACIFIER ASSEMBLY

(71) Applicant: Munchkin, Inc., Van Nuys, CA (US)

(72) Inventors: Sung Yun Chan, Pasadena, CA (US); Matthew Joseph Saxton, Agoura, CA (US)

(73) Assignee: Munchkin Inc., Van Nuys, CA (US)

( * ) Notice: Subject to any disclaimer, the term of this patent is extended or adjusted under 35 U.S.C. 154(b) by 224 days.

This patent is subject to a terminal disclaimer.

(21) Appl. No.: 15/653,470

(22) Filed: Jul. 18, 2017

(65) Prior Publication Data

US 2017/0319439 A1 Nov. 9, 2017

Related U.S. Application Data

(63) Continuation of application No. 14/458,820, filed on Aug. 13, 2014, now Pat. No. 9,707,158.

(60) Provisional application No. 61/865,553, filed on Aug. 13, 2013.

(51) Int. Cl.

| | |
|---|---|
| ***A61J 17/00*** | (2006.01) |
| ***A45F 5/02*** | (2006.01) |
| ***A61J 17/02*** | (2006.01) |
| ***A63H 5/00*** | (2006.01) |

(52) U.S. Cl.

CPC ..... *A61J 17/008* (2015.05); *A45F 5/02* (2013.01); *A61J 17/001* (2015.05); *A61J 17/02* (2013.01); *A61J 17/002* (2015.05); *A63H 5/00* (2013.01)

(58) Field of Classification Search

CPC ..... A45F 5/02; A61J 17/001; A61J 17/002; A61J 17/008; A61J 17/02; A61J 17/00; A63H 5/00

See application file for complete search history.

(56) References Cited

U.S. PATENT DOCUMENTS

| | | | | |
|---|---|---|---|---|
| 4,493,324 A * | 1/1985 | Johnston | ..... | A61J 17/008 606/236 |
| 5,211,656 A * | 5/1993 | Maddocks | ..... | A61J 17/001 606/234 |
| 9,707,158 B2 * | 7/2017 | Chan | ..... | A45F 5/02 |

* cited by examiner

*Primary Examiner* — Jocelin C Tanner

(74) *Attorney, Agent, or Firm* — Robert Z. Evora, Esq.

(57) ABSTRACT

A modular pacifier assembly having a modular mouth guard assembly including a nipple. The modular mouth guard assembly includes a mouth guard shield and a removable mouth guard plate that interconnects into the mouth guard shield.

20 Claims, 17 Drawing Sheets

FIG. 21
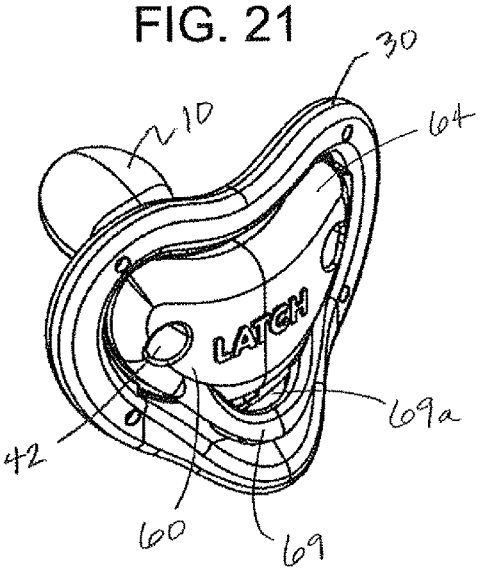
FIG. 22
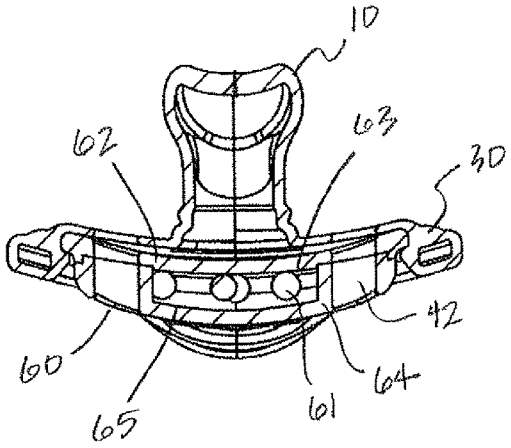
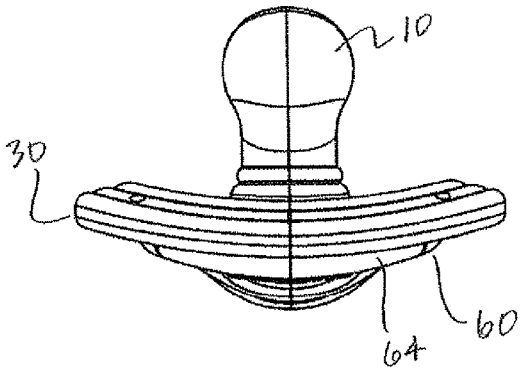
FIG. 23
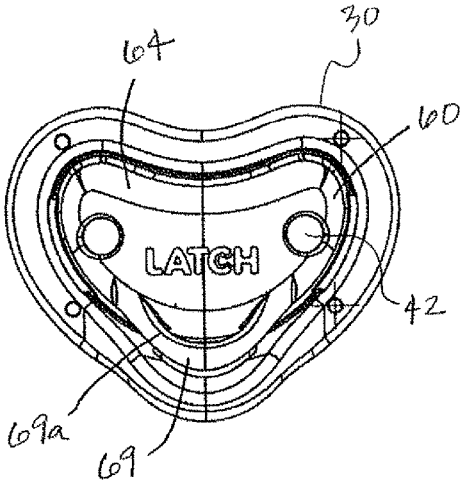
FIG. 24

FIG. 25
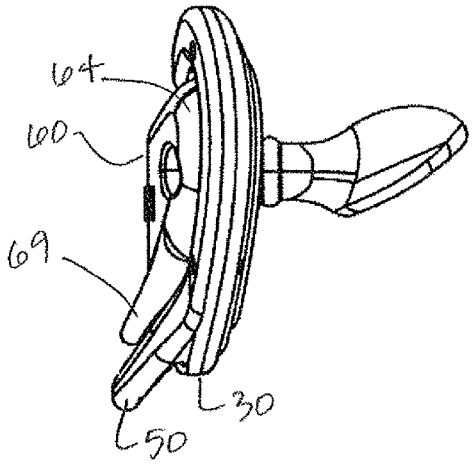
FIG. 26
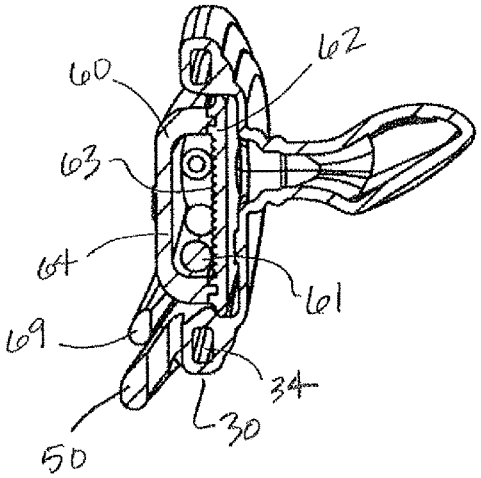
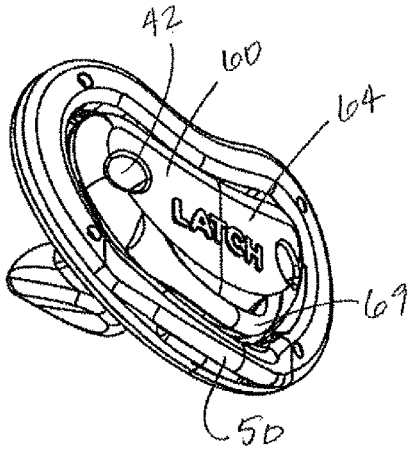
FIG. 27
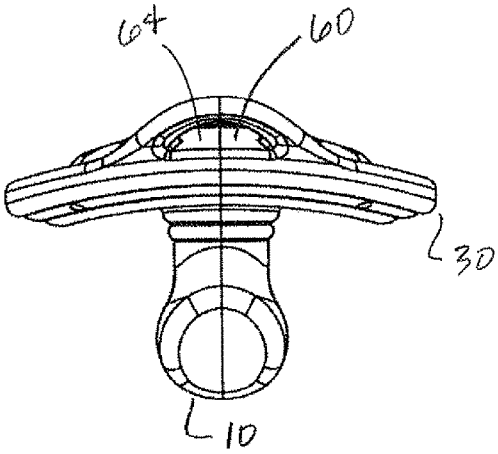
FIG. 28

FIG. 40
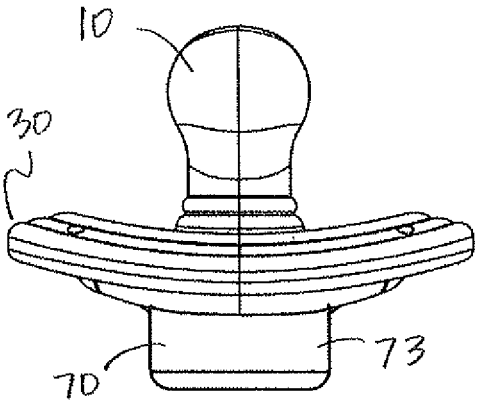
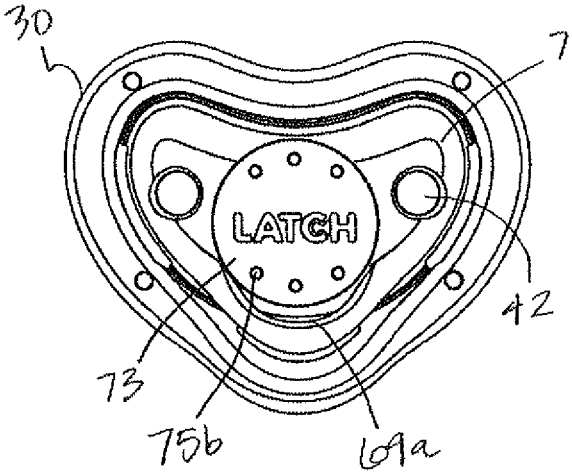
FIG. 41
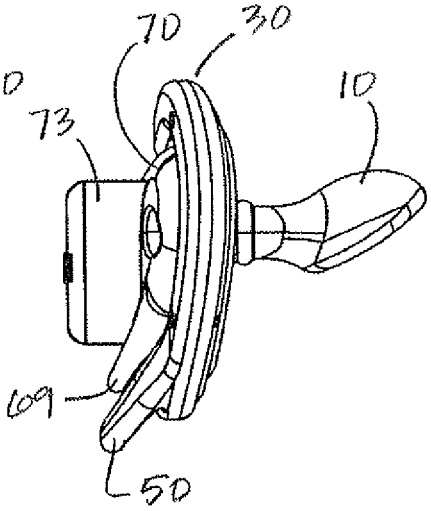
FIG. 42

FIG. 43
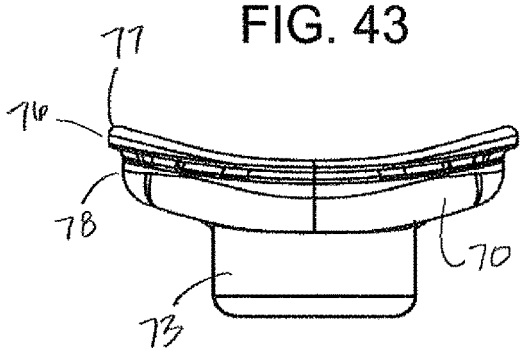
FIG. 44
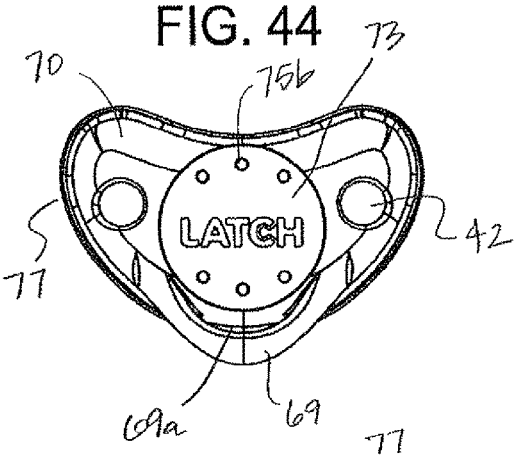
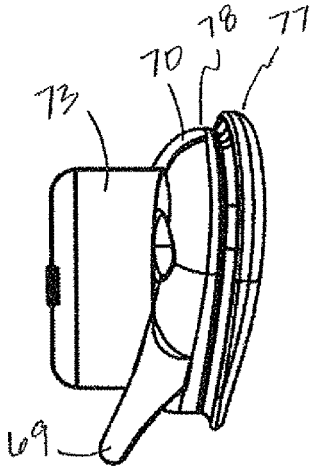
FIG. 45
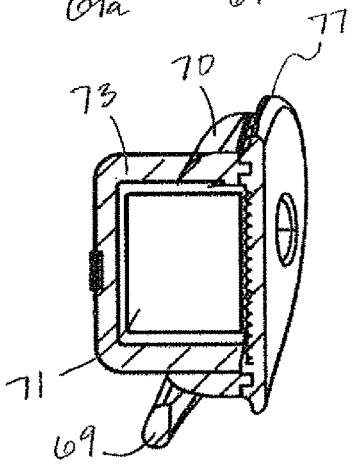
FIG. 46
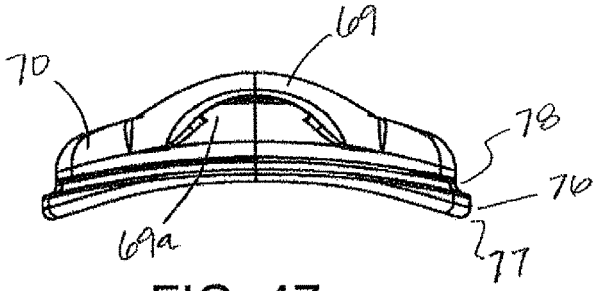
FIG. 47

MODULAR PACIFIER ASSEMBLY

CROSS REFERENCE TO RELATED APPLICATIONS

The application claims priority to U.S. Non-Provisional patent application Ser. No. 14/458,820, filed Aug. 13, 2014, which claims priority to U.S. Provisional Patent Application Ser. No. 61/865,553, filed Aug. 13, 2013; the contents of which are hereby incorporated by reference herein in their entirety into this disclosure.

TECHNICAL FIELD

The subject disclosure relates to a modular pacifier assembly, and in particular to a removable and interchangeable mouth guard shield for a modular pacifier assembly.

BACKGROUND

Conventionally, pacifiers are prone to collecting dirt and other unsanitary bacteria. Young infants and/or parents have the tendency to inadvertently drop the infant's pacifier on the floor or other unsanitary surface and inadequately rinse the pacifier and place it back into the infant's mouth with the unsanitary contaminants festering on the surface of the "binkie." Unfortunately, this practice can lead to various illnesses.

In a conventional nipple-type pacifier, the nursing end of the nipple is directly exposed to external elements and will tend to make direct contact with various unsanitary surfaces. Unfortunately, a frail still unvaccinated infant may be subjected to various contagious pathogens and the resultant diseases thereof.

There is a need to provide a pacifier assembly that would have less of a tendency to fall to the unclean ground when ejected from the infant's mouth.

BRIEF DESCRIPTION OF THE DRAWINGS

Various exemplary embodiments of this disclosure will be described in detail, wherein like reference numerals refer to identical or similar components or steps, with reference to the following figures, wherein:

FIGS. 21-28 depict various views of the modular pacifier assembly with the rattler housing plate.

FIGS. 40-42 depict various views of the modular pacifier assembly with the electronic housing unit.

FIGS. 43-47 show various views of the removable electronic housing unit of the modular pacifier assembly.

DETAILED DESCRIPTION

Particular embodiments of the present invention will now be described in greater detail with reference to the figures.

Figure 1:
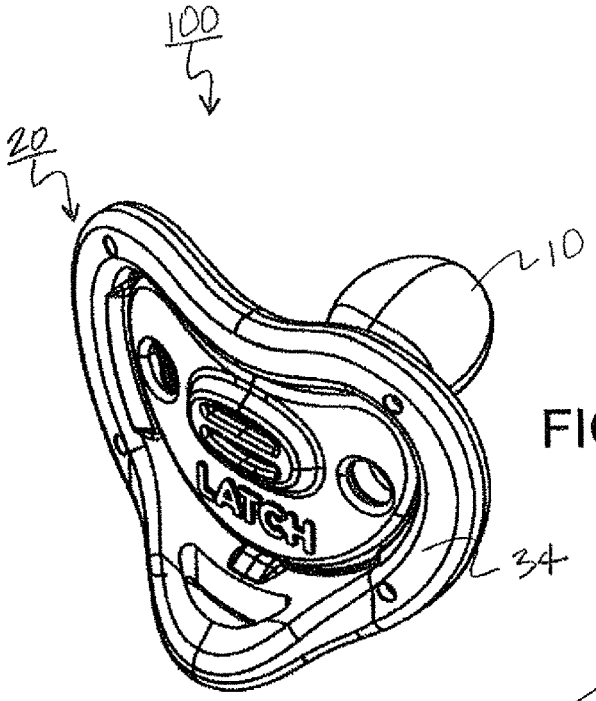
FIG. 1 illustrates a perspective view of the modular pacifier assembly according to this subject disclosure.
Figure 2:
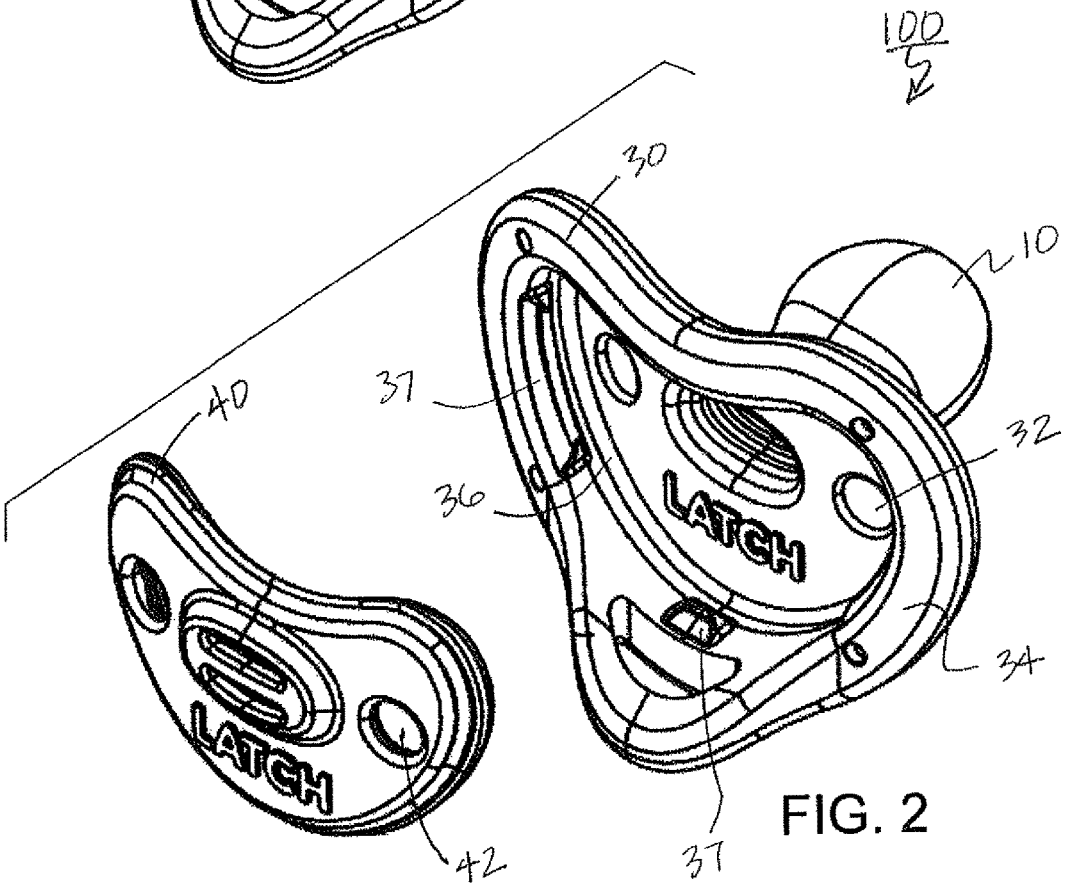
FIG. 2 shows an exploded view of the modular pacifier assembly.

FIGS. 1-2 show an exemplary perspective view and exploded view of a pacifier assembly 100 according to this subject disclosure. The modular pacifier assembly 100 comprises a flexible nipple 10 attached to a modular mouth guard assembly 20. The modular mouth guard assembly 20 has a two-piece construction with a mouth guard shield 30 and a removable mouth guard housing plate 40 that interconnects into the mouth guard shield 30.

FIGS. 3-9 depict different angles for the mouth guard shield 30 and nipple 10 in construction. The nipple 10 has a shaft 12 with a tip 13 at one end, and a concentric base 14 at the opposite end. The nipple 11 has a substantially circular cross-sectional shape that tapers outward along a longitudinal axis (A) of the nipple 10 from the base 14 to the tip 13. The tip 13 is substantially hemispherical in shape. The shaft 12 is preferably made of a relatively soft material, such as an elastomer or the like. Although the shaft 12 is shown as being a hollow tube, it may be solid. One skilled in the art will recognize that there are many shapes, sizes and compositions of nipples that may be used with a pacifier of the present invention.

The concentric base 14 connects to the mouth guard shield 30 at approximately it center. The mouth guard shield 30 serves as a mouth shield so that the modular pacifier assembly 100 cannot be swallowed by the infant thereby causing a choking hazard. The mouth guard shield 30 may also be comprised of a membrane of a flexible material.

A small concentric fold 15 is provided at the one end **14*a* of the nipple 10. The concentric fold 15 is adapted to allow the nipple 10 to reciprocate in and out and/or bend laterally with respect to the axis (A) as the infant alternatingly sucks and releases the nipple 10**.

Although not shown, the mouth guard shield 30 may also include a generally larger semi-toroid shaped fold that will allow the shaft 12 of the nipple 10 to reciprocate in and out a larger reciprocal distance along its longitudinal axis (A) as the infant alternatingly sucks and releases the nipple 10.

Figure 4:
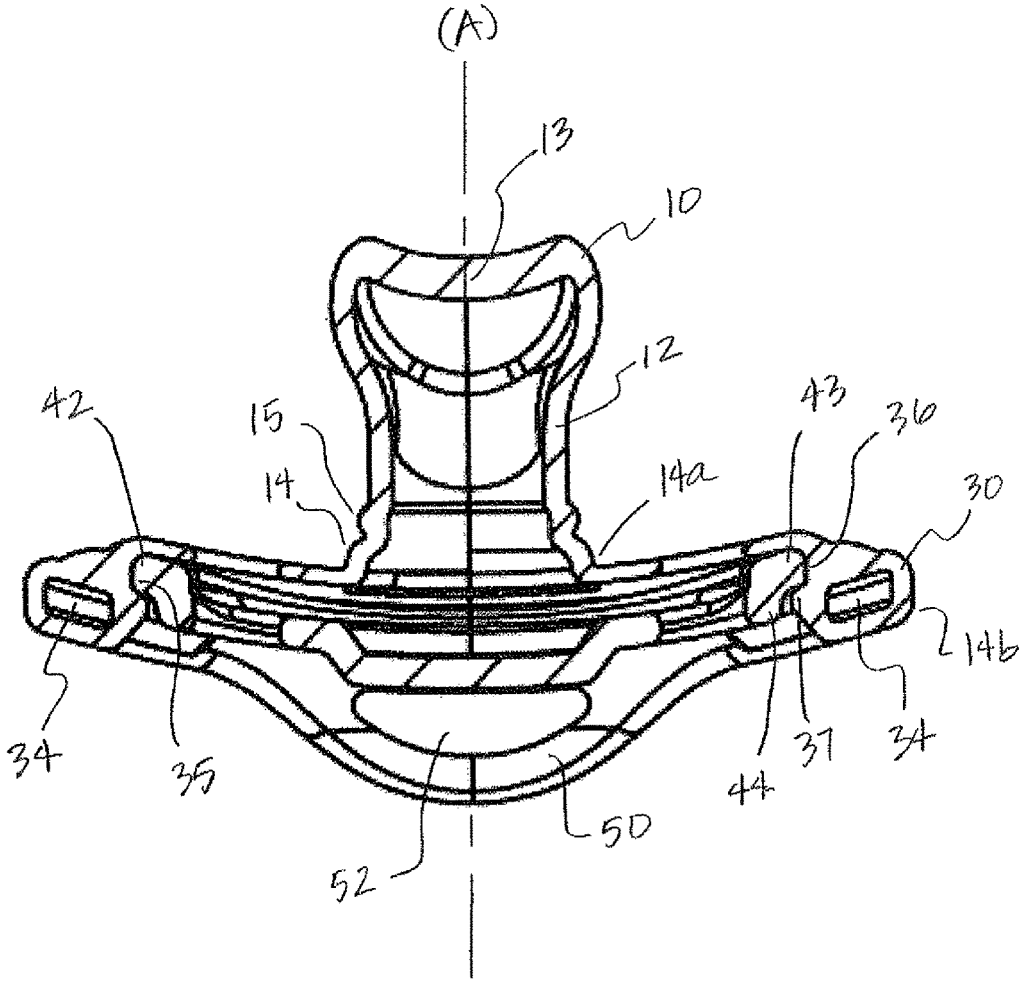

As shown in FIG. 4, the base 14 of the nipple 10 is connected at one end **14*a* to the mouth guard shield 30**.

The mouth guard shield 30 includes a concentric ring 34 that may be co-molded to surround an outer peripheral end of the mouth guard shield 30. The concentric ring 34 is substantially more rigid albeit flexible enough to flex. The ring 34 is generally annular in shape and provides stiffness to prevent an infant from collapsing the mouth guard shield 30 while in use. The ring 34 is generally formed with a bulbous radial thickness that defines a recess 35 having a raised surrounding therearound.

The concentric ring 34 is co-molded with a soft plastic or similar material that surrounds the ring 34, such as with a softer outer polymer conducive to teething by the infant.

However, it is to be understood that the outer co-molded covering surrounding the ring 34 may be made of any suitable material, such as hard or soft plastic, natural or synthetic elastomer and/or any other suitable material. The outer layer may also be constructed with a separate material component from an additional annular mounting over-layer attached by adhesive bonding, chemical bonding, heat welding or the like.

The removable mouth guard housing plate 40 is adapted to fit within the recess 35 in a slip fit manner. The recess 35 is also constructed in a kidney bean shape. As shown in FIG. 4, an undercut notch 36 may be constructed defining a shoulder 37 at the base of the recess 35 adjacent to a back end of the mouth guard shield 30 to securely hold an extending flange 42 in a peripheral edge of the second mouth guard 40. In assembly, the extending flange 42 of the second mouth guard 40 is locked within the undercut notch 36 within the recess 35. The shoulder 37 may encompass the entire periphery of the base of the recess 35 and form a concentric undercut notched cavity in the recess 35. As shown in FIG. 2, the shoulder 37 may also encompass a partition or multiple partitions of the periphery as well, to form a partial undercut notched cavity in the recess 35.

As shown in FIG. 4, the thickness of the ring 34 may be a small fraction of the diameter of its outer periphery. However, it is to be understood, the ring 34 may be any suitable thickness. To provide the necessary stiffness, the ring 34 may be made of a flexible rigid material, such as but not limited to, a relatively sturdy plastic, such as polyethylene, rubber or any other suitable material according to this subject disclosure.

A handle 50 may be attached to the mouth guard shield 30. The handle 50 may include a gripping ring 52 portion disposed as part of the handle 50. The handle 50 may be secured to the ring 34 of the mouth guard shield 30 as a co-molded element of the outer ring 34 surrounding the mouth guard shield 30.

Figure 6:
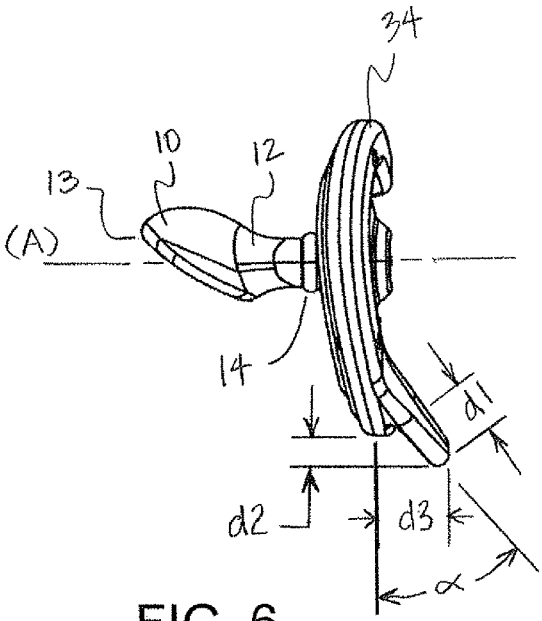

As shown in FIG. 6, the handle 50 may be constructed to project at an angle away from, and outward of, the rear face of the ring 34 of the mouth guard shield 30 so that the removable mouth guard housing plate 40 is not obstructed during its installation and removal. The angular extending handle extends a predetermined distance away from the outer ring 34 to allow easier grasping of a gripping ring 52 by an infant or an adult supervising an infant.

In particular, the handle 50 may extend at an angle (a) a first distance (d1) away from a peripheral edge of the outer ring 34. In this position, the handle 50 extends outward a second distance (d2) beyond the outer peripheral edge of the outer ring 34 in a radial direction. Likewise, the handle 50 extends outward a third distance (d3) beyond the outer peripheral edge of the outer ring 34 in an axial direction (A).

The gripping ring 52 is a generally elongate finger grip extending from the outer ring 34 of the mouth guard shield 30. Ends of the gripping ring 52 are attached to the peripheral ends of the outer ring 34. In the alternative, the handle 50 may be integrated as part of the removable mouth guard housing plate 40 portion.

Although the annular ring 34 is shown in the shape of a kidney bean, it is understood that any possible ring shape is possible according to this subject disclosure. For example, the ring structure 34 may be shaped like an ellipse, a crescent shape, a rectangle having rounded corners, a star, and an outline of an animal or the like.

Various methods for attaching the base ring 34 to the mouth guard shield 30 is possible, such as for example, but not limited to over molding, adhesive bonding, chemical bonding, heat welding and/or any other suitable method in accordance with this subject disclosure may be used.

Figure 3:
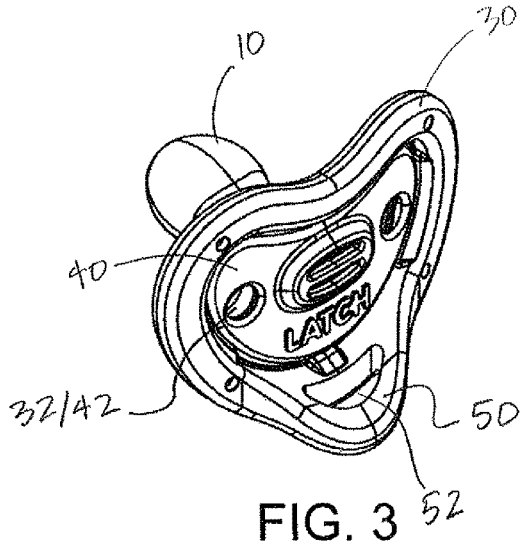
FIGS. 3-10 depict various views of the modular pacifier assembly.
Figure 5:
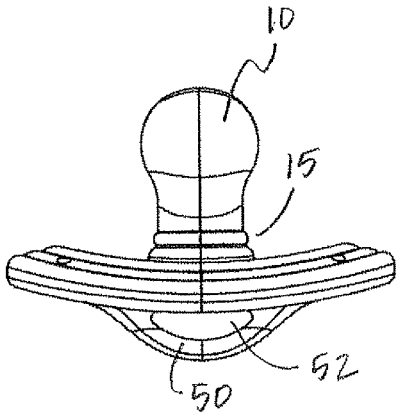
Figure 8:
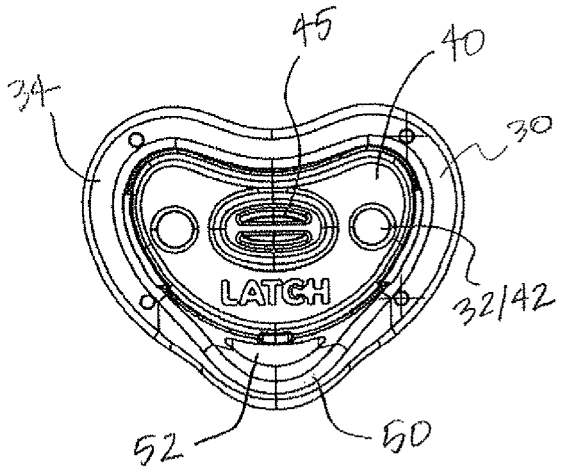
Figure 9:
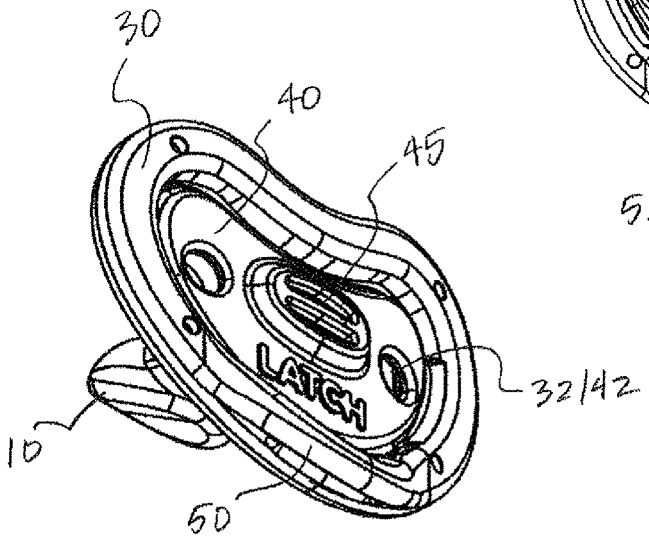
Figure 10:
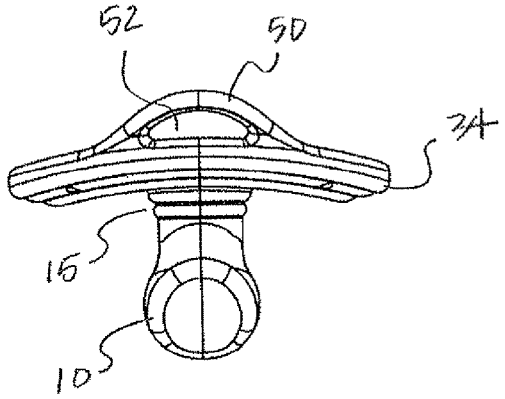
Figure 12:
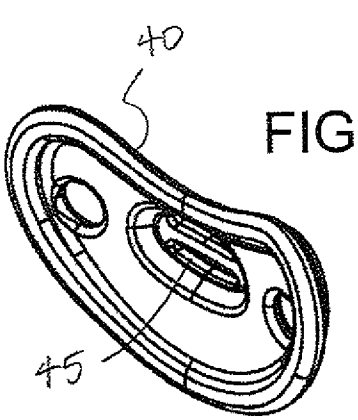
FIGS. 11-18 illustrate various views of the removable mouth guard housing plate of the modular pacifier assembly.
Figure 11:
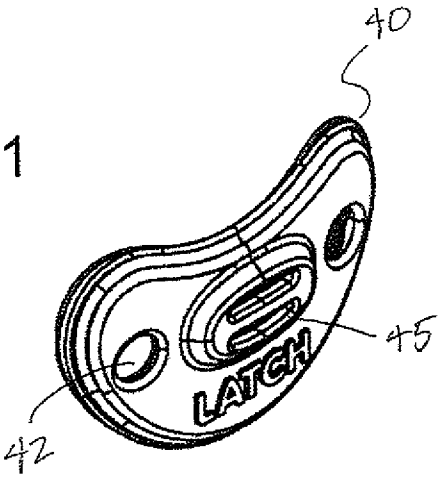
Figure 13:
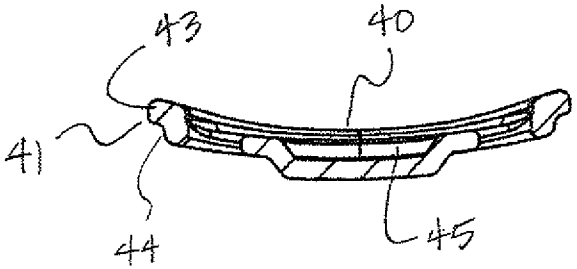
Figure 14:
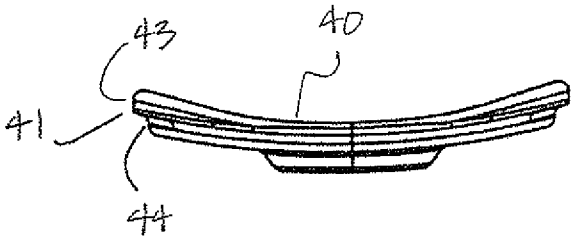
Figure 18:
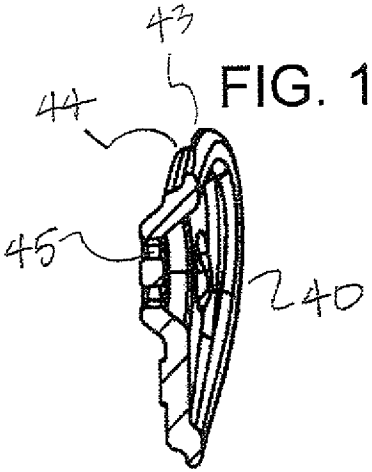
Figure 16:
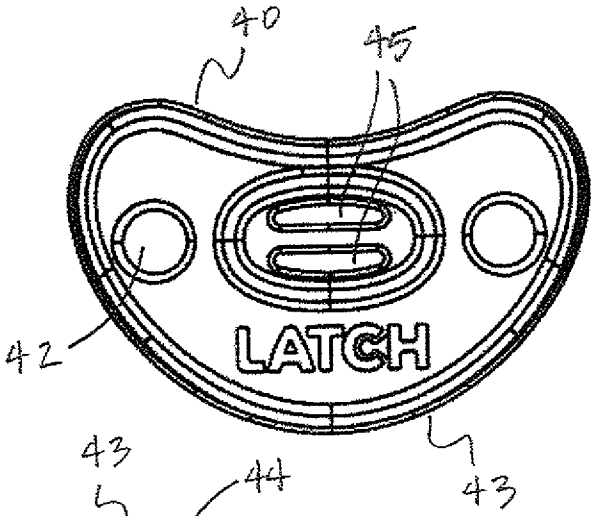
Figure 17:
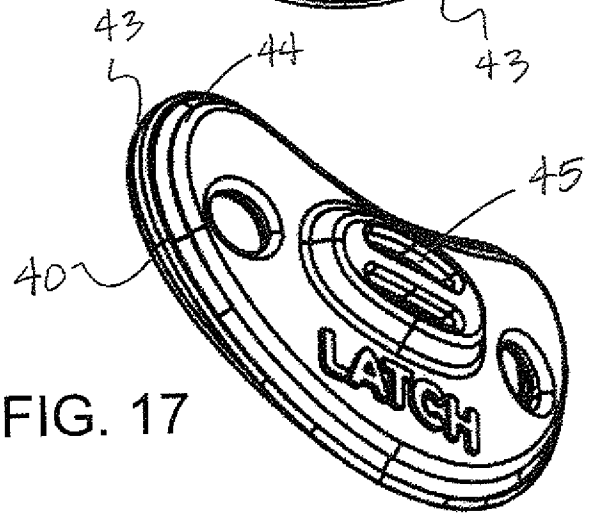
Figure 15:
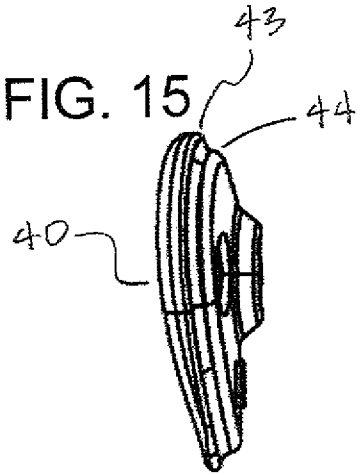

Various apertures 32, 42 may be provided in the mouth guard shield 30 and the removable mouth guard housing plate 40 respectively. As shown in FIGS. 2, 3 and 8, the apertures 32 in the mouth guard shield 30 are aligned with the apertures 42 in the removable mouth guard housing plate 40 to provide ventilation for the infant's mouth when it wraps its mouth around the nipple 10 and buts up against the mouth guard shield 30. Although two apertures 32, 42 are shown in each of the mouth guard shield 30 and the removable mouth guard housing plate 40 respectively, any number of apertures, or none at all, may be provided therein. In addition, the apertures 32, 42 may be located anywhere on the modular pacifier assembly 100 to provide ventilation to the infant while in use.

Since the pacifier assembly 100 is modular, after use, the mouth guard housing plate 40 can be easily removed from the mouth guard shield 30. As such, the modular pacifier assembly 100 can be easily cleaned inside and out.

FIGS. 11-18 depict various views of the removable mouth guard housing plate 40 of the modular mouth guard assembly 20. The mouth guard housing plate 40 has a kidney bean shape sized and shaped to fit within the kidney bean shaped recess 35 defined on the rear side of the mouth guard shield 30. As shown in a side view in FIGS. 13-14 and 19, the mouth guard housing plate 40 is slightly bowed in shape to mate with the bowed shape of the mouth guard shield 30. The mouth guard housing plate 40 has a predetermined thickness adapted to slip fit within the recess 35 defined by the outer ring 34 on the mouth guard shield 30.

As shown, peripheral edges 41 of the mouth guard housing plate 40 includes a stepped shoulder construction having a flange 43 and an inward shoulder 44 disposed at its outermost peripheral edge 41. The flange 43 is constructed to fit within the recess 35 and to be securely held by the shoulder 37 of the mouth guard shield 30 structure as shown in FIG. 4. The shoulder 37 of the mouth guard shield 30 rests against the inward shoulder 44 of the mouth guard housing plate 40 in a mating fashion.

A pair of loop holes 45 are formed in the mouth guard housing plate 40. The loop holes 45 are adapted to receive a flexible hook 56 of the clip fastener 54. The flexible hook 56 is attached to a first end of a strap 55. The second end of the strap 55 being attached to a clamp fastener 58 such as shown in FIGS. 48-53. The clamp fastener 58 being adapted to be fastened to an object such as an article of clothing worn by an infant so that if the modular pacifier assembly 100 falls from the mouth of the infant, the attached strap 55 will catch the modular pacifier assembly 100 and prevent it from falling onto the ground or other unsanitary surface.

Figure 7:
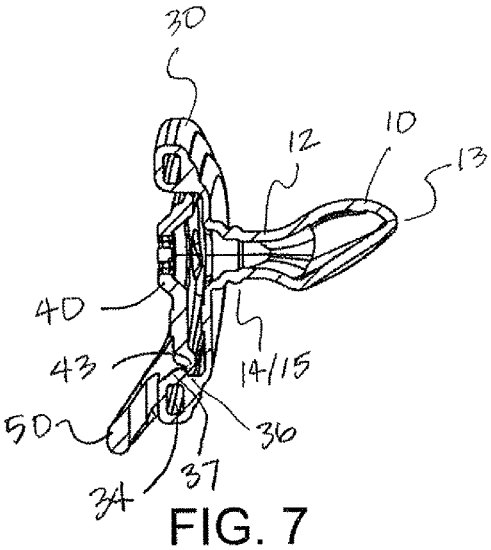

As mentioned before, apertures 42 are also disposed in the mouth guard housing plate 40 and are adapted to fluidly communicate with the apertures 32 in the mouth guard shield 30 thereby allowing aeration and the infant to breath when their mouth covers the mouth guard shield 30. As shown in FIGS. 2-3 and 7, the apertures 32, 42 are aligned within the mouth guard shield 30 and the mouth guard housing plate 40 to air to communicate across the various apertures 32, 42.

The mouth guard housing plate 40 is removable and interchangeable with various other mouth guard housing plate components, such as a rattle housing plate 60 (as show in FIGS. 19-36), an electronic housing plate 70 (as shown in FIGS. 37-47) or the like.

Figure 19:
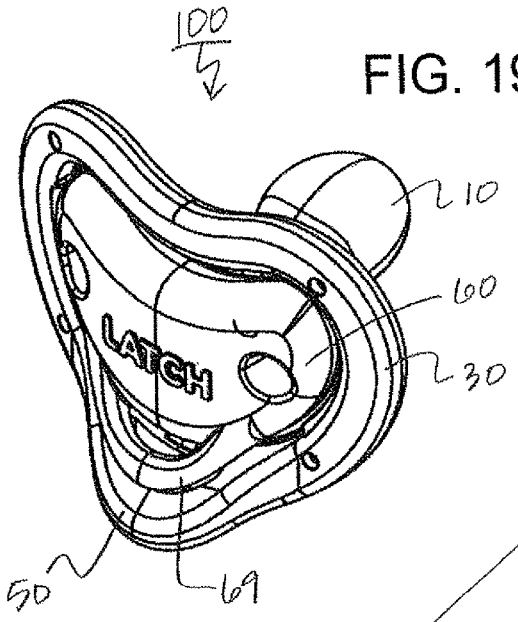
FIG. 19 illustrates a perspective view of the modular pacifier assembly having a rattler housing plate.
Figure 20:
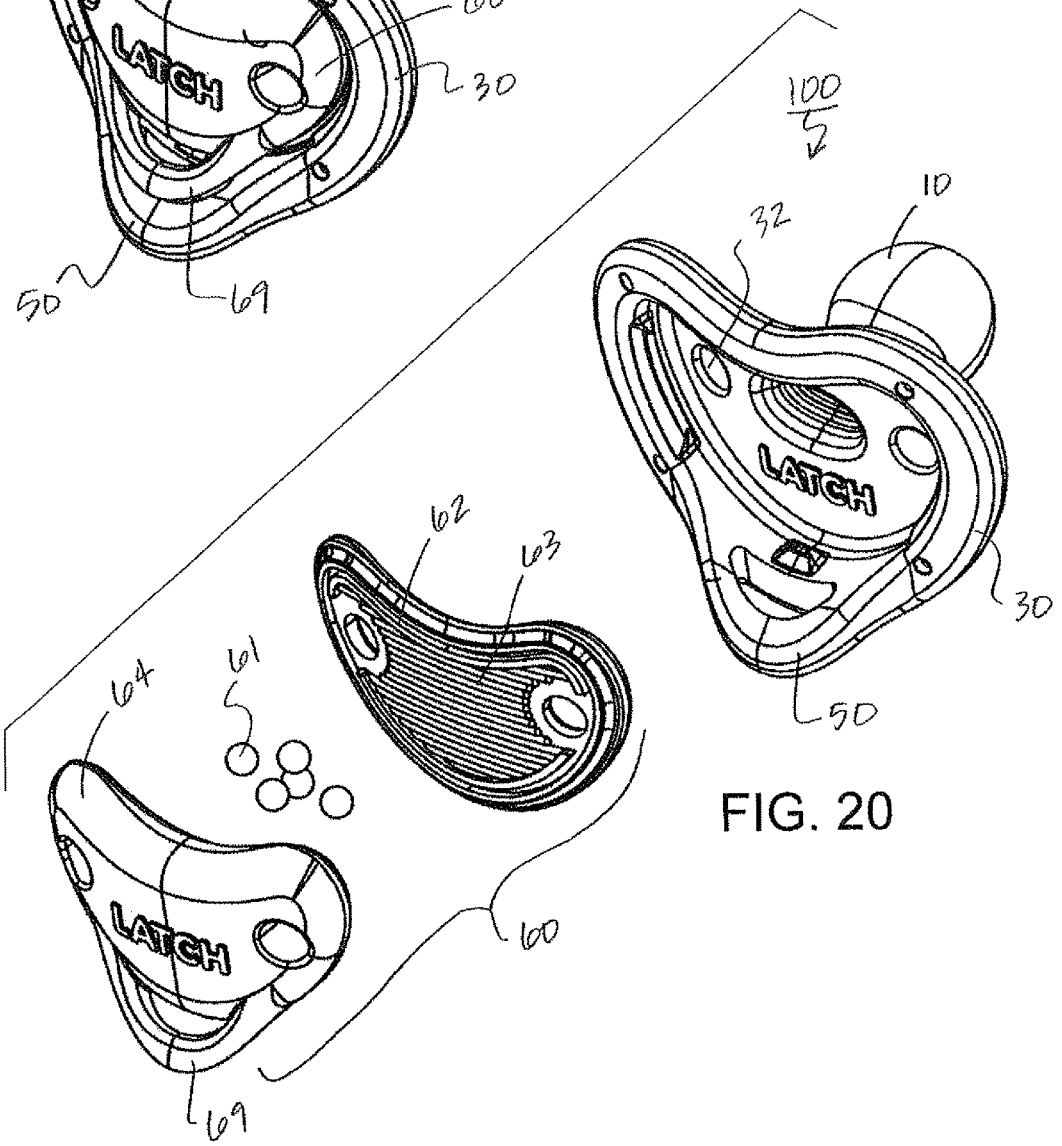
FIG. 20 shows an exploded view of the modular pacifier assembly with the rattler housing plate.
Figure 29:
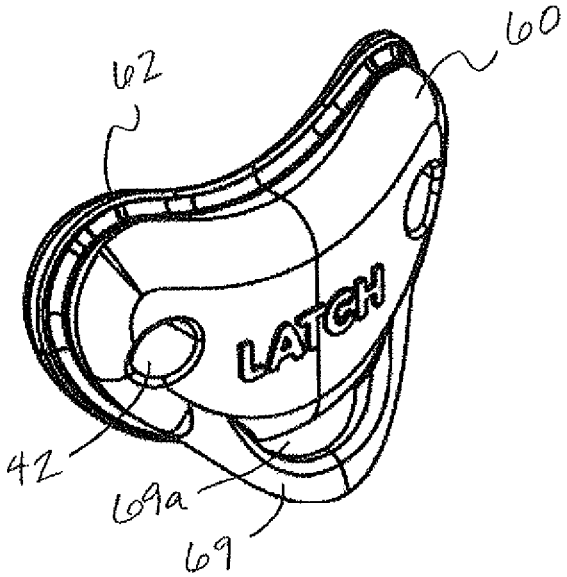
FIGS. 29-36 show various views of the removable rattler housing plate of the modular pacifier assembly.
Figure 30:
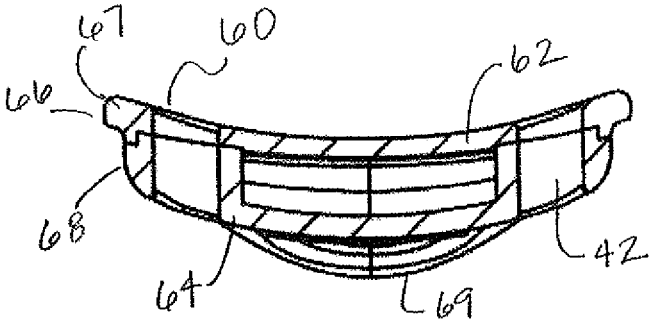
Figure 31:
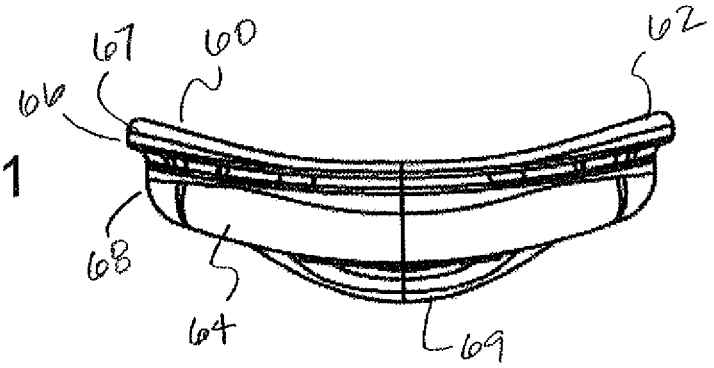
Figure 34:
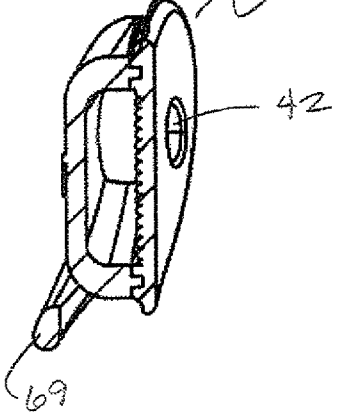
Figure 33:
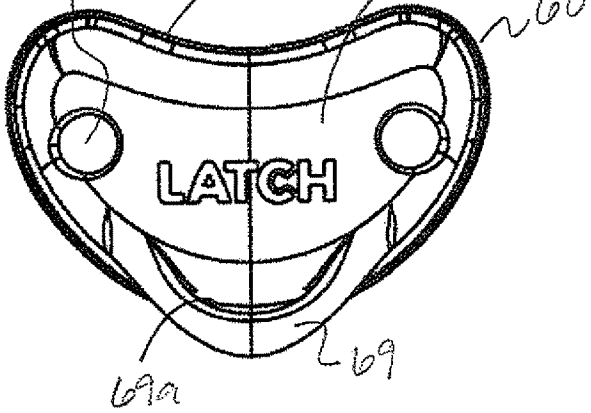

FIGS. 19-20 illustrate a perspective and exploded views of the modular pacifier assembly 100 including a mouth guard shield 30 attached to a nipple 10 and adapted to receive a rattle housing plate 60. The construction of the mouth guard shield 30 is similar to the construction discussed above.

The rattle housing plate 60 includes various balls 61 contained between an outer cover 64 and an inner plate 62. The rattle housing 60 may have an inner surface 63 that can be a flat construction as shown in FIG. 22 in cross section, or may have a textured surface such as the undulated surface shown in FIGS. 20 and 26. The textured surface inner surface 63 is provided to enhance the rattle sound within the rattle housing plate 60 as the balls 61 are shaken therein. An inner surface 65 on the outer cover 64 may also be a smooth surface or may be a textured surface as well.

FIGS. 29-36 depict various views of the rattle housing plate 60 including the outer cover 64 attached to the inner plate 62. As above, the inner plate 62 lies within and is secured to the recess 35 in the mouth guard shield 30. The outer cover 64 and the inner plate 62 are both substantially constructed in a kidney bean shape in order to fit within the kidney bean shaped recess 35 defined on the rear side of the mouth guard shield 30. As shown in a side view and side cross section view in FIGS. 22 and 26, the inner plate 62 is slightly bowed in shape to mate with the bowed shape of the mouth guard shield 30. The inner plate 62 also has a predetermined thickness adapted to slip fit within the recess 35 defined by the outer ring 34 on the mouth guard shield 30.

Peripheral edges 66 of the inner plate 62 includes a stepped shoulder construction having a flange 67 and an inward shoulder 68 disposed at its outermost peripheral edge 66. The flange 67 is constructed to fit within the recess 35 and to be securely held by the shoulder 37 of the mouth guard shield 30 structure as shown in FIG. 22. The shoulder 37 of the mouth guard shield 30 rests against the inward shoulder 68 of the mouth guard housing plate 40 in a mating fashion.

Figure 32:
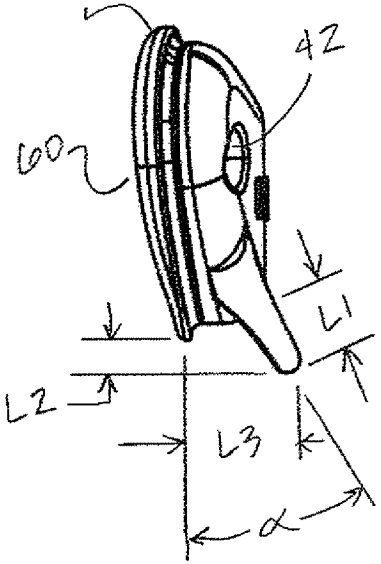
Figure 36:
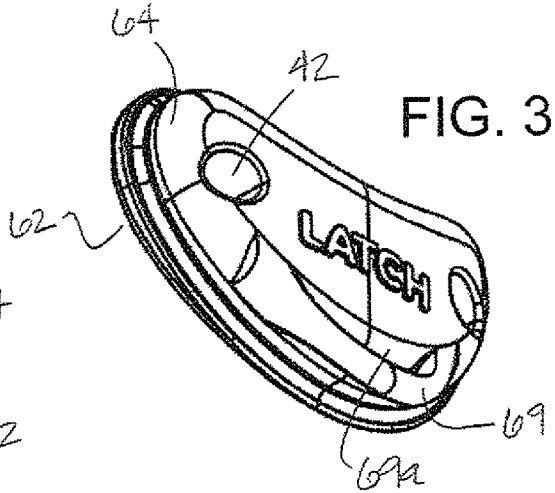
Figure 35:
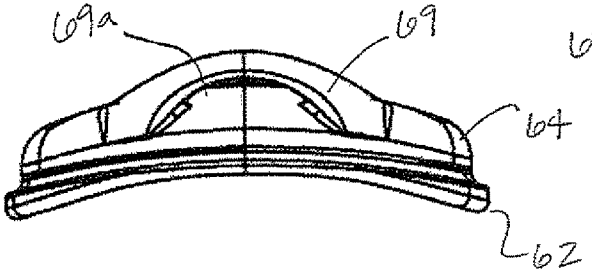

A second handle 69 may extend from an outer peripheral edge of the outer cover 64. As shown in FIG. 32, and similar to the handle 50 above, the second handle 69 on the outer cover 64 may extend at an angle (β) a first distance (L1) away from a peripheral edge of the inner plate 62. In this position, the second handle 69 extends outward a second distance (L2) beyond the outer peripheral edge of the inner plate 62 in a radial direction. Likewise, the second handle 69 extends outward a third distance (L3) beyond the outer peripheral edge of the inner plate 62 in an axial direction (A). As shown in FIGS. 25-26, the second handle 69 extends substantially in the same direction as the handle 50 and adjacent thereto.

Figure 50:
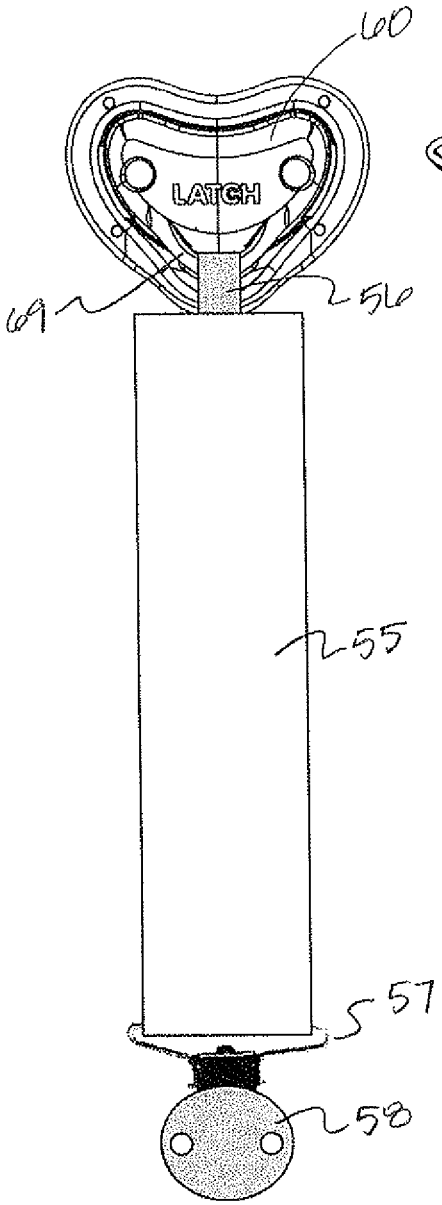
FIGS. 50-51 show a front and side cross section view of the modular pacifier assembly with the rattler plate.
Figure 51:
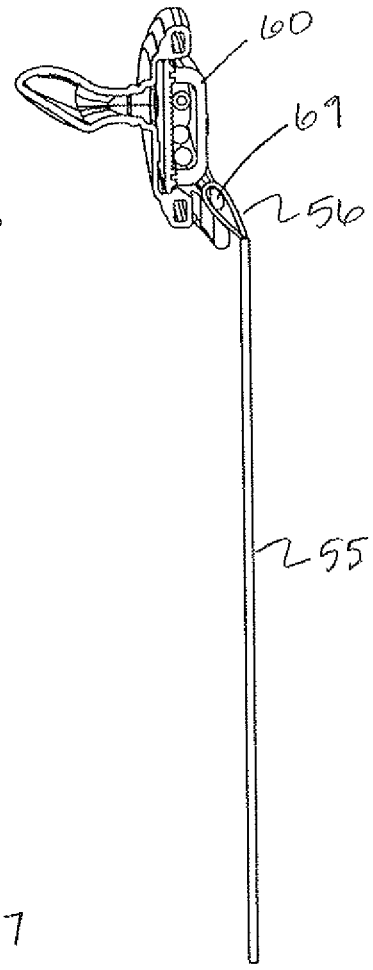
Figure 52:
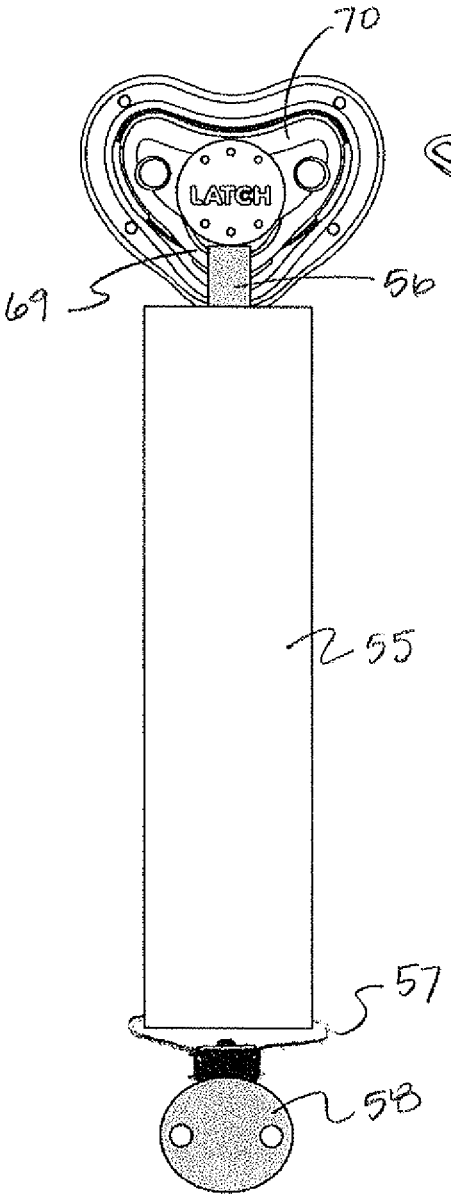
FIGS. 52-53 show a front and side cross section view of the modular pacifier assembly with the electronic housing unit.
Figure 53:
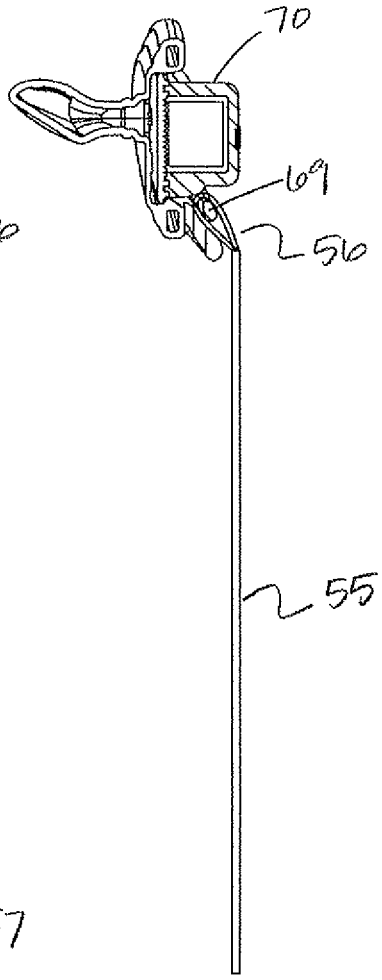

The second handle 69 forms a generally open loop 69*a*. The open loop 69*a* is adapted to receive a flexible hook 56 of the clip fastener 54 such as shown in FIGS. 50-51. As shown, the open loop 69*a* is attached to a first end of a strap 55. The second end of the strap 55 being attached to a clamp fastener 58 such as shown in FIGS. 48-53. The clamp fastener 58 being adapted to be fastened to an object such as an article of clothing worn by an infant so that if the modular pacifier assembly 100 falls from the mouth of the infant, the attached strap 55 will catch the modular pacifier assembly 100 and prevent it from falling onto the ground or other unsanitary surface.

FIGS. 37-47 illustrate a perspective and exploded views of the modular pacifier assembly 100 including a mouth guard shield 30 attached to a nipple 10 and adapted to receive an electronic housing plate 70. The construction of the mouth guard shield 30 is similar to the construction discussed above.

Figure 39:
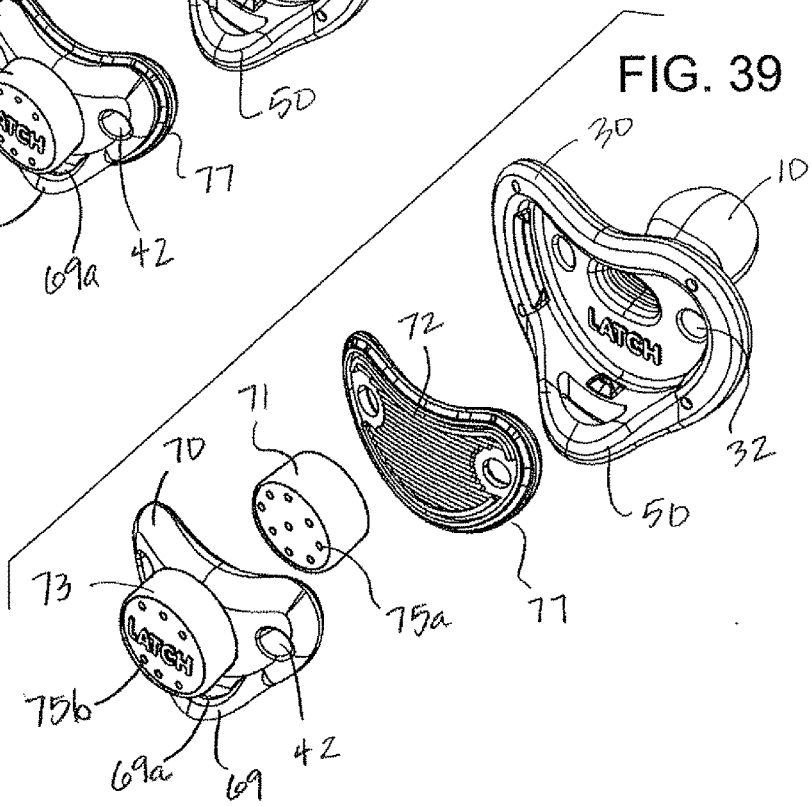
FIG. 39 shows an exploded view of the modular pacifier assembly with the electronic housing unit.
Figure 48:
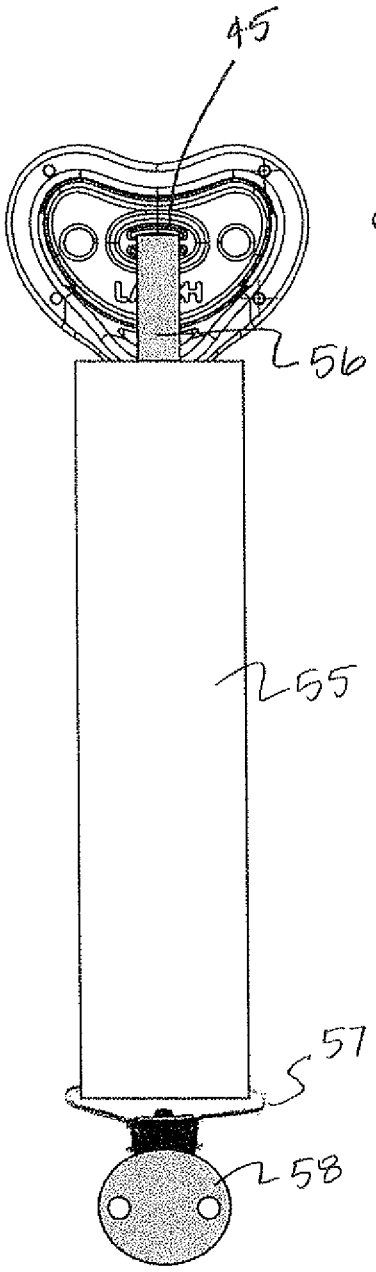
FIGS. 48-49 show a front and side cross section view of the modular pacifier assembly.
Figure 49:
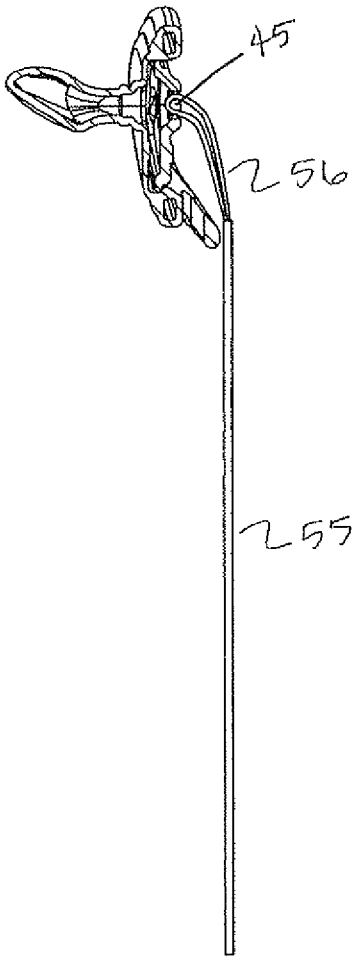

As shown in FIG. 39, the electronic housing plate 70 includes an electronic unit 71 disposed between an outer cover 74 and an inner plate 72. The outer cover 74 includes a projection 73 extending therefrom that is adapted to house and secure the electronic unit 71 between the outer cover 74 and an inner plate 72. Embodied as an audible unit, the electronic unit includes an electronic circuit with a speaker provided therein and various through hole apertures 75*a* in the electronic unit and in the outer cover 75*b* in order to allow sound generated by the speaker circuit to emanate though the outer covering 74.

Various electronic components can be integrated into the electronic unit 71, such as a heart beat monitor modular circuit, a vibration element circuit, a musical device circuit and/or any other electronic component in accordance with this subject disclosure. The electronic unit 71 may be encased in a waterproof barrier and/or other type of moisture proof barrier according to the subject disclosure.

FIGS. 37-46 depict various views of the electronic plate 70 including the outer cover 74 attached to the inner plate 72. As above, the inner plate 72 lies within and is secured to the recess 35 in the mouth guard shield 30. The outer cover 74 and the inner plate 72 are both substantially constructed in planar rear view as a kidney bean shape in order to fit within the kidney bean shaped recess 35 defined on the rear side of the mouth guard shield 30. As shown in a side view and side cross section view in various side views in FIGS. 43 and 47, the inner plate 72 is slightly bowed in shape to mate with the bowed shape of the mouth guard shield 30. The inner plate 72 also has a predetermined thickness adapted to slip fit within the recess 35 defined by the outer ring 34 on the mouth guard shield 30.

Figure 37:
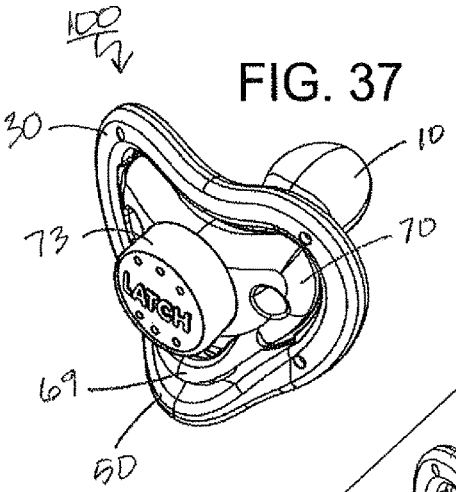
FIG. 37 illustrates a perspective view of the modular pacifier assembly having an electronic housing unit.
Figure 38:
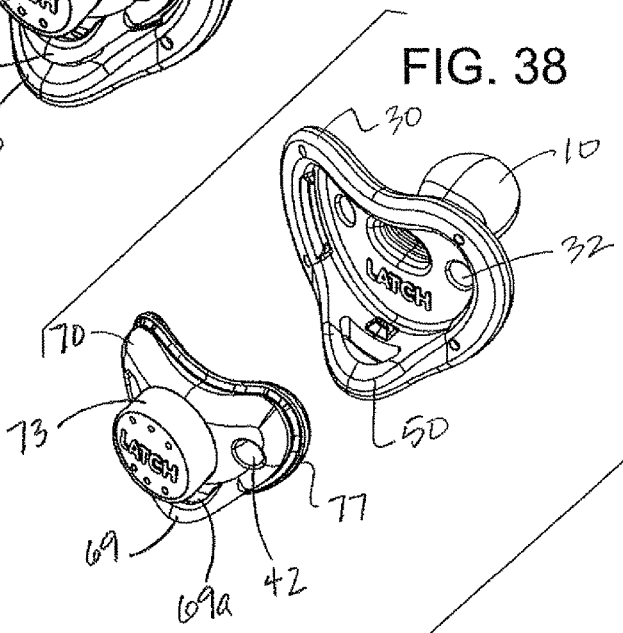
FIG. 38 shows a partial exploded view of the modular pacifier assembly with the electronic housing unit.

Peripheral edges 76 of the inner plate 72 includes a stepped shoulder construction having a flange 77 and an inward shoulder 78 disposed at its outermost peripheral edge 76. The flange 77 is constructed to fit within the recess 35 and to be securely held by the shoulder 37 of the mouth guard shield 30 structure as shown in FIG. 37 and in the previous embodiment for the rattle housing plate 60 in FIG. 22 which has a similar construction. The shoulder 37 of the mouth guard shield 30 rests against the inward shoulder 78 of the mouth guard housing plate 40 in a mating fashion.

The second handle 69 is also shown constructed into this embodiment. As described in detail above with respect to the rattle housing plate 60, the second handle 69 may extend from an outer peripheral edge of the outer cover 74. As shown in FIGS. 45 and 32, and similar to the handle 50 above, the second handle 69 on the outer cover 74 may extend at an angle (β) a first distance (L1) away from a peripheral edge of the inner plate 72. In this position, the second handle 69 extends outward a second distance (L2) beyond the outer peripheral edge of the inner plate 72 in a radial direction. Likewise, the second handle 69 extends outward a third distance (L3) beyond the outer peripheral edge of the inner plate 72 in an axial direction (A). As shown in FIGS. 37 and 41-42, the second handle 69 extends substantially in the same direction as the handle 50 and adjacent thereto.

The second handle 69 forms a generally open loop 69*a*. The open loop 69*a* is adapted to receive a flexible hook 56 of the clip fastener 54 such as shown in FIGS. 50-51. As shown, the open loop 69*a* is attached to a first end of a strap 55. The second end of the strap 55 being attached to a clip or clamp fastener 58 such as shown in FIGS. 48-53. The clamp fastener 58 being adapted to be fastened to an object such as an article of clothing worn by an infant so that if the modular pacifier assembly 100 falls from the mouth of the infant, the attached strap 55 will catch the modular pacifier assembly 100 and prevent it from falling onto the ground or other unsanitary surface.

The clip fastener 54 may have an adjustable tightening mechanism that can incrementally tighten the clamp fastener 58 onto the preferred garment on the infant such that the modular pacifier assembly 100 happens to fall out of the infant's mouth, the modular pacifier assembly 100 will be caught by the clip fastener 54 secured to the garment thereby preventing the modular pacifier assembly 100 from falling to the ground. Likewise, the clip fastener 54 is also an advantage in permitting the modular pacifier assembly 100 to be accessible to the infant at their disposal, as it will be conveniently clipped at a location where the infant can readily grab it and use it whenever they choose. This convenience eliminates the reliance on the caregiver having to give the modular pacifier assembly 100 to infant each time they desire the use of the modular pacifier assembly 100.

The modular pacifier assembly 100 can be embodied in a variety of different sizes, shapes and configurations. The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A modular pacifier assembly comprising:
a flexible nipple; and
a modular mouth guard assembly comprising:
a mouth guard shield having an upper surface, a first side, a second side, and an outer peripheral edge, the first side attached to the nipple; and
a housing plate having an upper surface and an outer peripheral edge of the housing plate having a stepped shape with a flange and an inset shoulder disposed adjacent thereto, and wherein when the housing plate is attached and secured to the mouth guard shield behind the first side, the flange and inset shoulder fit securely within at least a partial undercut notched cavity in a recess of the mouth guard shield,
wherein the mouth guard shield and the housing plate are both shaped to mate with each other.

2. The modular pacifier assembly recited in claim 1, wherein the mouth guard shield has at least one aperture.

3. The modular pacifier assembly recited in claim 2, wherein the housing plate has at least one aperture aligned with at least one aperture on the mouth guard shield.

4. The modular pacifier assembly recited in claim 1, wherein the housing plate is adapted to receive a clip fastener.

5. The modular pacifier assembly recited in claim 1, wherein at least one handle is attached to and extends outwardly at an angle beyond the outer peripheral edge of the mouth guard shield in a radial direction and beyond the outer peripheral edge in an axial length.

6. The modular pacifier assembly recited in claim 5, wherein the at least on handle is adapted to receive a clip fastener.

7. The modular pacifier assembly recited in claim 1, wherein the housing plate is at least one of a rattler housing plate and an electronic unit plate housing.

8. The modular pacifier assembly recited in claim 1, wherein at least one of a first handle on a peripheral edge of the mouth guard shield and a second handle on the peripheral edge of the housing plate is adapted to be attached to a clip fastener.

9. The modular pacifier assembly recited in claim 1, wherein the housing plate has a housing disposed within into which various loose elements are contained and are adapted to rattle.

10. The modular pacifier assembly recited in claim 1, wherein the housing plate has a housing into which an electronic unit is contained.

11. The modular pacifier assembly recited in claim 1, wherein the upper surface is concave and the bottom surface is rounded.

12. A modular pacifier assembly comprising:
a flexible nipple; and
a modular mouth guard assembly comprising:
a mouth guard shield having an upper surface, a first side, a second side and an outer peripheral edge, the first side attached to the nipple; and
a housing plate having an upper surface and an outer peripheral edge of the housing plate has an inset shoulder disposed adjacent thereto, wherein the housing plate is attached and secured behind the first side of the mouth guard shield by a slip fit, such that the inset shoulder fits securely within a recess in the second side of the mouth guard shield,
wherein the mouth guard shield and the housing plate are both concave-shaped and adapted to mate with each other.

13. The modular pacifier assembly recited in claim 12, wherein the mouth guard has at least one aperture.

14. The modular pacifier assembly recited in claim 12, wherein a handle is attached to and extends outwardly at an angle beyond the outer peripheral edge of the mouth guard shield in a radial direction, and beyond the outer peripheral edge in an axial length.

15. The modular pacifier assembly recited in claim 14, wherein a second handle is attached to the housing plate and extends outwardly at another angle beyond the outer peripheral edge of the housing plate in another radial direction, and beyond the outer peripheral edge of the housing plate in another axial length.

16. A modular pacifier assembly comprising:
a flexible nipple; and
a modular mouth guard assembly comprising:
a mouth guard shield having a concave upper surface, a first side, a second side, and an outer peripheral edge, the first side attached to the nipple;
a housing plate having a concave upper surface and removably attaching to the second side of the mouth guard shield, wherein an outer peripheral edge of the housing plate has a stepped shape with a flange and an inset shoulder disposed adjacent thereto, and wherein when the housing plate is attached and secured behind the first side of the mouth guard shield, the flange and inset shoulder fit securely within at least a partial undercut notched cavity in a recess of the mouth guard shield; and
a first handle that extends outwardly at an angle beyond the outer peripheral edge of the mouth guard shield in a radial direction and beyond the outer peripheral edge in an axial length, and wherein the mouth guard shield and the housing plate are both concave-shaped and are adapted to mate with each other.

17. The modular pacifier assembly recited in claim 16, wherein the mouth guard shield has at least one aperture.

18. The modular pacifier assembly recited in claim 17, wherein the housing plate has at least one aperture aligned with at least one aperture on the mouth guard shield.

19. The modular pacifier assembly recited in claim 16, wherein a second handle is attached to the housing plate and extends outwardly at another angle beyond the outer peripheral edge of the housing plate in another radial direction and beyond the outer peripheral edge of the housing plate in another axial length.

20. The modular pacifier assembly recited in claim 19, wherein at least one of the first handle and the second handle is adapted to receive a clip fastener.

* * * * *